US009757789B2

(12) United States Patent
Tanoue et al.

(10) Patent No.: US 9,757,789 B2
(45) **Date of Patent: *Sep. 12, 2017**

(54) METHOD OF MANUFACTURING RECTANGULAR TUBE HAVING STEPPED PORTION

(71) Applicant: NISSHIN STEEL CO., LTD., Tokyo (JP)

(72) Inventors: Ryuji Tanoue, Sakai (JP); Hirokazu Sasaki, Sakai (JP); Naofumi Nakamura, Sakai (JP); Jun Kurobe, Sakai (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 75 days.

This patent is subject to a terminal disclaimer.

(21) Appl. No.: 14/229,351

(22) Filed: Mar. 28, 2014

(65) Prior Publication Data

US 2015/0273558 A1 Oct. 1, 2015

Related U.S. Application Data

(63) Continuation of application No. PCT/JP2012/074869, filed on Sep. 27, 2012.

(30) Foreign Application Priority Data

Sep. 30, 2011 (JP) ..... 2011-217071

(51) Int. Cl.
*B21D 41/04* (2006.01)
*B21D 17/02* (2006.01)
(Continued)

(52) U.S. Cl.
CPC ..... *B21D 41/04* (2013.01); *B21D 17/02* (2013.01); *B21C 5/00* (2013.01); *B21C 5/003* (2013.01); *B21K 21/12* (2013.01)

(58) Field of Classification Search
CPC ..... B21D 17/02; B21D 17/08; B21D 41/04; B21D 27/024; B21D 41/045; B21C 5/00;
(Continued)

(56) References Cited

U.S. PATENT DOCUMENTS 1,979,430 A * 11/1934 Wright ..... B21D 15/02 428/34.1
1,983,074 A * 12/1934 Durell ..... B21D 15/02 428/34.1
(Continued)

FOREIGN PATENT DOCUMENTS

CA 2283734 A1 9/1998
CN 1136479 A 11/1996
(Continued)

OTHER PUBLICATIONS

Office Action dated Apr. 1, 2015, in counterpart Chinese Patent Application No. 201280047618.2, 7 pages.
(Continued)

*Primary Examiner* — Teresa M Ekiert
*Assistant Examiner* — Gregory Swiatocha
(74) *Attorney, Agent, or Firm* — Tracy M. Helms; Apex Juris, pllc.

(57) ABSTRACT

A method of manufacturing a rectangular tube having a stepped portion includes: forming V-shaped grooves on a rectangular tube at surfaces of an end thereof in a direction parallel to a longitudinal direction thereof; and pressing each of the surfaces having the V-shaped grooves formed thereon from outside to inside, whereby the end of the rectangular tube is radially reduced.

5 Claims, 13 Drawing Sheets

(51) Int. Cl.
*B21C 5/00* (2006.01)
*B21K 21/12* (2006.01)

(58) Field of Classification Search
CPC ... B21C 5/003; B21C 37/0803; B21C 37/104; B21C 37/155; B21J 5/022; B21J 9/022; B21J 13/025; B21J 9/025; B21B 17/08; B21B 27/024
USPC ..... 72/370.01, 370.02, 370.04, 370.13, 72/370.03, 370.12, 367.1, 368, 370.26, 72/370.21
See application file for complete search history.

(56) References Cited

U.S. PATENT DOCUMENTS

| | | | | | |
|---|---|---|---|---|---|
| 1,994,725 | A * | 3/1935 | Offutt | B21D 41/04 | 165/177 |
| 2,055,771 | A * | 9/1936 | McLaughlin | B21C 1/22 | 428/595 |
| 3,042,099 | A * | 7/1962 | Neely | B21D 7/06 | 72/369 |
| 3,144,070 | A * | 8/1964 | Mieszczak | B21C 5/00 | 72/370.12 |
| 3,370,451 | A * | 2/1968 | Schuetz | B21C 5/00 | 72/402 |
| 3,399,559 | A * | 9/1968 | Mitchell | B21C 5/00 | 72/294 |
| 4,350,036 | A * | 9/1982 | Valente | B21C 5/00 | 72/402 |
| 4,982,487 | A | 1/1991 | Maruko et al. | | |
| 5,907,969 | A * | 6/1999 | Soder | B21D 41/04 | 72/208 |
| 6,757,974 | B2 * | 7/2004 | Kido | B21C 37/065 | 29/522.1 |
| 8,833,127 | B2 * | 9/2014 | Tomizawa | B21C 37/155 | 72/128 |
| 2004/0139777 | A1 | 7/2004 | Waldrop | | |
| 2015/0273548 | A1 | 10/2015 | Tanoue | | |

FOREIGN PATENT DOCUMENTS

| | | | |
|---|---|---|---|
| CN | 2426774 | Y | 4/2001 |
| CN | 1745930 | A | 3/2006 |
| CN | 102172724 | A | 9/2011 |
| JP | P491974-6037 | B1 | 2/1974 |
| JP | S496037 | B1 | 2/1974 |
| JP | S4929628 | Y1 | 8/1974 |
| JP | U491974-29628 | Y1 | 8/1974 |
| JP | S5212768 | Y2 | 3/1977 |
| JP | U521977-12768 | Y2 | 3/1977 |
| JP | 58187224 | | 11/1983 |
| JP | S58187224 | A | 11/1983 |
| JP | U061994-19938 | Y1 | 3/1994 |
| JP | U06199419938 | Y1 | 3/1994 |
| JP | P2001-522310 | A | 11/2001 |
| JP | P 2001-522310 | A | 11/2001 |
| JP | P3359947 | B2 | 10/2002 |
| JP | P581983-187224 | A | 3/2014 |
| NZ | WO2010/021553 | A1 | 2/2010 |
| WO | WO2010013273 | A1 | 2/2010 |

OTHER PUBLICATIONS

English translation of the body text of the Office Action dated Apr. 1, 2015, in counterpart Chinese Patent Application No. 201280047618.2, 4 pages.
Office Action dated Oct. 26, 2015, in counterpart Chinese Patent Application No. 201280047618.2.0, 5 pages.
English translation of the body text of the Office Action dated Oct. 26, 2015, in counterpart Chinse Patent Application No. 201280047618.2, 2 pages.
Non-Final Office Action mailed Feb. 12, 2016, U.S. Appl. No. 14/229,440, 16 pages.
Final Office Action mailed Jul. 29, 2016, U.S. Appl. No. 14/229,440, 9 pages.
Office Action mailed May 23, 2016, in Chinese Application No. 201280047837.0, with English translation, 9 pages.
Office Action dated Sep. 25, 2015, in counterpart Chinese Patent Application No. 201280047837.0, 5 pages.
English translation of the body text of the Office Action dated Sep. 25, 2015, in counterpart Chinse Patent Application No. 201280047837.0, 2 pages.
Office Action dated Apr. 3, 2015, in counterpart Chinese Patent Application No. 201280047837.0, 5 pages.
English translation of the body text of the Office Action dated Apr. 3, 2015, in counterpart Chinese Patent Application No. 201280047837.0, 3 pages.
Office Action issued Jul. 27, 2016, in Taiwanese Patent Application No. 101135477, 8 pages.
Non-final Office Action issued for U.S. Appl. No. 14/229,440, dated Apr. 20, 2017, 22 pages.

* cited by examiner

METHOD OF MANUFACTURING RECTANGULAR TUBE HAVING STEPPED PORTION

CROSS REFERENCE TO RELATED APPLICATIONS

This is a continuation application of International Patent Application No. PCT/JP2012/074869 filed on Sep. 27, 2012 claiming priority upon Japanese Patent Application No. 2011-217071 filed on Sep. 30, 2011, of which full contents are incorporated herein by reference.

BACKGROUND OF THE INVENTION

Field of the Invention

The present invention relates to a method of manufacturing a rectangular tube having a stepped portion for connection formed at an end thereof.

Description of the Background Art

The rectangular construction tubes used for fences or barriers have been generally assembled in such a fashion that a plurality of rectangular tube members each having a predetermined length are formed, and thereafter, the plurality of formed rectangular tube members are butted one another, and the formed rectangular tube members abutting one another are fixed through connection members. However, the use of connection members has caused increase in component count and cost. Furthermore, the use of such connection members has sometimes caused an undesirable appearance.

For the purpose of reducing cost, there has been proposed a method of: radially reducing an end of one rectangular tube; and inserting the radially reduced end into an end (non-radially reduced end) of another rectangular tube so as to connect the rectangular tubes (see patent document 1).

For example, patent document 1 proposes a method of: radially reducing an end of one round tube through the use of a die; connecting the radially reduced end with an end (non-radially reduced end) of another round tube; and thereafter, forming the connected round tubes into a rectangular tube by roll forming.

In the roll forming described in patent document 1, a plurality of roll stands equipped with rolls each having a predetermined dimension are installed around the connected round tubes. Such connected round tubes are inserted into the rolls so as to form a rectangular tube having a predetermined dimension. Rectangular tube members manufactured by such a method are used for fences or barriers.

PRIOR ART DOCUMENT

Patent Document

Patent Document 1: Japanese Patent No. 3359947

Problems to be Solved

The method proposed in patent document 1 has required at least: the step of manufacturing a round tube at roll stands; the step of radially reducing one end of the round tube off-line; the step of connecting a plurality of round tubes; the step of returning the connected round tubes to the roll stands; and the step of forming the connected round tubes into a rectangular tube.

Generally, a rectangular tube has been manufactured by: making a round tube at roll stands; and thereafter, continuously passing the round tube through roll stands so as to form the round tube into a rectangular tube. In other words, if the method proposed by patent document 1 is adopted, an activity to transfer the round tubes to the station where the tube-radially reducing step is carried out would be required at the timing after the round tubes are manufactured at the roll stands before the round tubes are formed into the rectangular tubes, which would cause a problem that the burden of product management and process management regarding the round tubes is increased. Furthermore, since the round tubes are radially reduced by inserting such round tubes into a die, dies corresponding to the outer diameter of the round tube as well as the dimension of radially reduced end thereof would have to be prepared, which would cause another problem that the cost for such dies is increased.

SUMMARY OF THE INVENTION

The present invention is come up with in order to solve the above problems. The object of the present invention is to propose a method of manufacturing a rectangular tube having a stepped portion at an end thereof, whose appearance is desirable, by carrying out a simple manufacturing step through the use of an easy-to-use device at low cost.

Means for Solving Problems

In order to achieve the above object, the method of manufacturing a rectangular tube having a stepped portion according to the present invention is characterized by comprising: forming V-shaped grooves on a rectangular tube at surfaces of an end thereof in a direction parallel to a longitudinal direction thereof; and pressing each of the surfaces having the V-shaped grooves formed thereon from outside to inside, whereby the end of the rectangular tube is radially reduced.

It is preferable that the above step of forming the V-shaped grooves on the rectangular tube at the surfaces of the end thereof comprises the following steps of: placing a first die having a V-shaped concave portion formed thereon inside the end of the rectangular tube; placing a second die having a V-shaped convex portion formed thereon at a position that is opposite to the concave portion and is outside the end of the rectangular tube; and pressing the second die against the rectangular tube at each of the surfaces of the end thereof.

Further, it is preferable that the second die has an inclined surface on a side opposite to a surface thereof contacting the rectangular tube, and a fixed base is arranged to be fixed at a position opposite to the rectangular tube across the second die, whereby the V-shaped grooves are formed by squeezing a wedge-shaped tool between the fixed base and the inclined surface of the second die so as to move the second die toward the rectangular tube.

Still further, it is preferable that a third die having an inclined surface on a side opposite to a surface thereof contacting the rectangular tube is placed, and a fixed base is arranged to be fixed at a position opposite to the rectangular tube across the third die, whereby the end of the rectangular tube is radially reduced by squeezing a wedge-shaped tool between the fixed base and the inclined surface of the third die so as to move the third die toward the rectangular tube and press the end of the rectangular tube.

Advantageous Effects of the Invention

According to the present invention, the radially reduced portion is formed on the rectangular tube at the end thereof by forming the V-shaped grooves on the rectangular tube at the surfaces of the end thereof in a direction parallel to the longitudinal direction thereof in advance, and pressing each of the surfaces of the end thereof through the use of a flat external die. Using this method, there is no need to transport a round tube to the station where a tube-radially reducing step is carried out before the round tube is formed into the rectangular tube. Further, in the tube-radially reducing step, there is no need to prepare the dies corresponding to the outer diameter of the round tube and the dimension of the radially reduced end thereof, but the dies having very simple shapes and structures are sufficient for the tube-radially reducing step. The rectangular tube having a stepped portion of excellent appearance can be obtained in the simple tube-radially reducing step at low cost. In particular, this method can render the maintenance as being easier in comparison with the method using a die.

Still further, the radially reduced portion formed on the rectangular tube at the end thereof has a shape corresponding to a cross-sectional shape thereof, and is used as a good connection portion. A plurality of rectangular tubes can therefore be connected by simply fitting the radially reduced end of one tube in the open end of another tube, thereby enabling easy construction of high quality fences and barriers designed to harmonize with the adjacent buildings.

BRIEF DESCRIPTION OF THE DRAWINGS

For more thorough understanding of the present invention and advantages thereof, the following descriptions should be read in conjunction with the accompanying drawings, in which.

DESCRIPTION OF EMBODIMENTS OF THE INVENTION

The inventors have studied a forming method of forming a radially reduced portion formed on a rectangular tube at the end thereof with superior forming precision at low cost, and a connecting method of connecting two rectangular tube members by inserting one rectangular tube having a stepped portion, which is manufactured by the forming method, into the end (at which a radially reduced end is not formed) of another rectangular tube.

When a rectangular tube is formed with a radially reduced portion at the end thereof, which is rectangular in cross section, there are many embodiments that two edges opposite to each other at the end of the rectangular tube are pressed from outside to inside. However, the other two edges (two non-pressed edges) adjacent to the two pressed edges are bent outward to the extent that a distance between the two pressed edges is shortened. Furthermore, the two initially pressed edges are bent outward by subsequently pressing the other two bent edges. For this reason, each edge of the radially reduced rectangular tube at the end thereof is bent, which makes it difficult to insert the radially reduced end of one rectangular tube into the non-radially reduced end of another rectangular tube when connecting two rectangular tubes.

In the present invention, therefore, V-shaped grooves are formed on an outer surface of a rectangular tube in a direction parallel to a longitudinal direction of the rectangular tube before pressing two opposite edges of the rectangular tube from outside to inside. A processing method of processing the rectangular tube in such a fashion that the V-shaped grooves are formed thereon will be described with reference to FIGS. 1 to 6.

Figure 1:
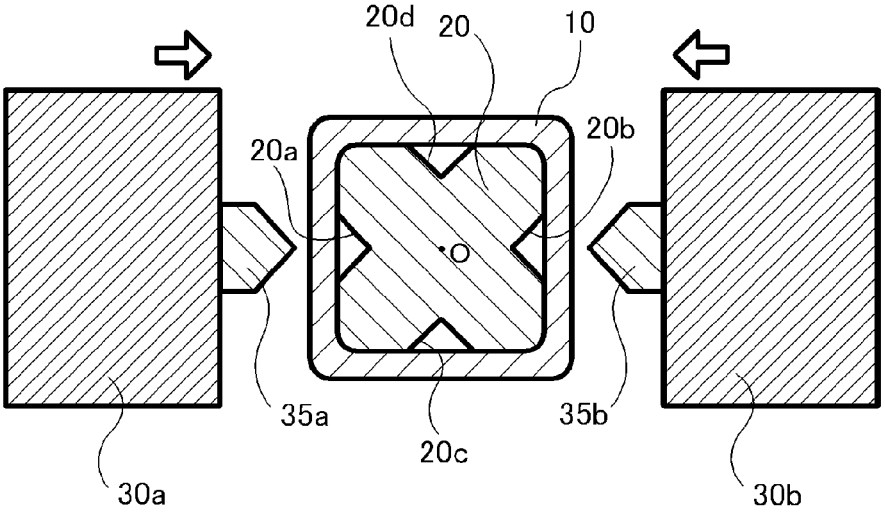
FIG. 1 depicts a cross-sectional view showing an end of a rectangular tube having an internal die inserted therein, and V-shaped external dies.

Initially, an internal die (20) having V-shaped concave portions (20*a*, 20*b*, 20*c*, 20*d*) formed on an outer surface thereof is inserted into an end of a rectangular tube (10) (see FIG. 1). Subsequently, V-shaped external dies (30*a*, 30*b*) having V-shaped convex portions (35*a*, 35*b*) formed on their respective surfaces are arranged across the rectangular tube (10) such that the V-shaped convex portions (35*a*, 35*b*) are opposite to the concave portions (20*a*, 20*b*, 20*c*, 20*d*) of the internal die (20). In FIG. 1, the V-shaped external die (30*a*) having the V-shaped convex portion (35*a*) formed on a surface thereof is arranged such that the V-shaped convex portion (35*a*) is opposite to the concave portion (20*a*) of the internal die, and the V-shaped external die (30*b*) having the V-shaped convex portion (35*b*) formed on a surface thereof is arranged such that the V-shaped convex portion (35*b*) is opposite to the concave portion (20*b*) of the internal die.

Subsequently, the end of the rectangular tube (10) having the internal die (20) inserted therein is pressed from outside to inside by one V-shaped external die (30*a*) and the other V-shaped external die (30*b*) while interposed therebetween. At this moment, the convex portion (35*a*) and the other convex portion (35*b*) are pressed against the concave portions (20*a*, 20*b*) of the internal die (20) such that the convex potions (35*a*, 35*b*) and the concave portions (20*a*, 20*b*) are aligned, respectively (see FIG. 2). After the step shown in FIG. 2, the rectangular tube (10) is rotated approximately 90 degrees around the center (O) of the cross-section across a longitudinal direction of the rectangular tube, which is regarded as substantially a center of rotation, and the two edges having no V-shaped grooves formed thereon are pressed by one V-shaped external die (30*a*) and the other V-shaped external die (30*b*) in a similar fashion (see FIG. 3). Through such steps, the V-shaped grooves are formed on their respective surfaces of the rectangular tube (10) at the end thereof.

Figure 2:
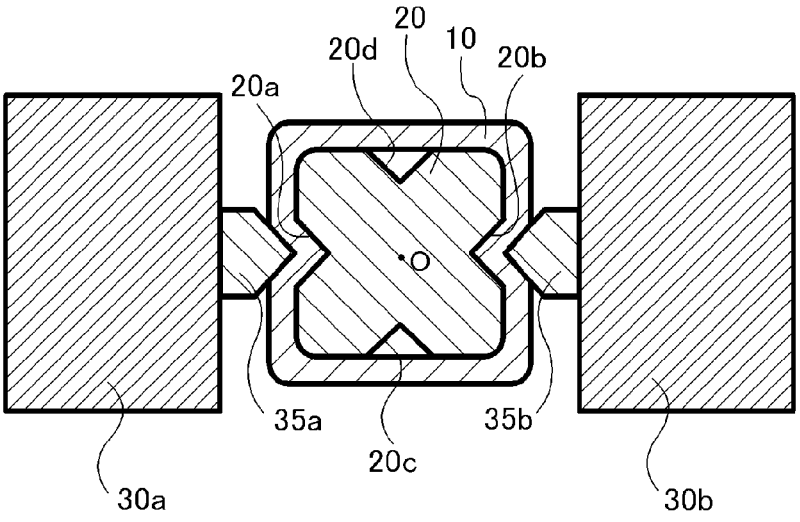
FIG. 2 depicts a cross-sectional view showing one step of forming V-shaped grooves on the rectangular tube at the end thereof.
Figure 3:
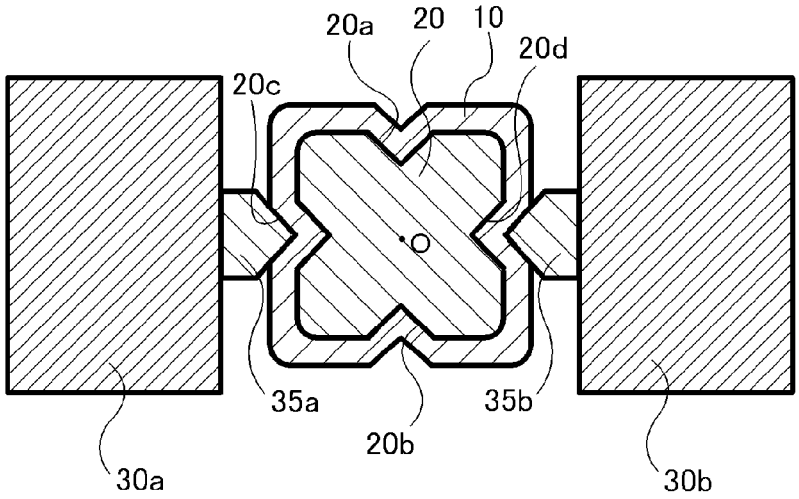
FIG. 3 depicts a cross-sectional view showing further step of forming further V-shaped grooves on the rectangular tube at the end thereof.
Figure 4:
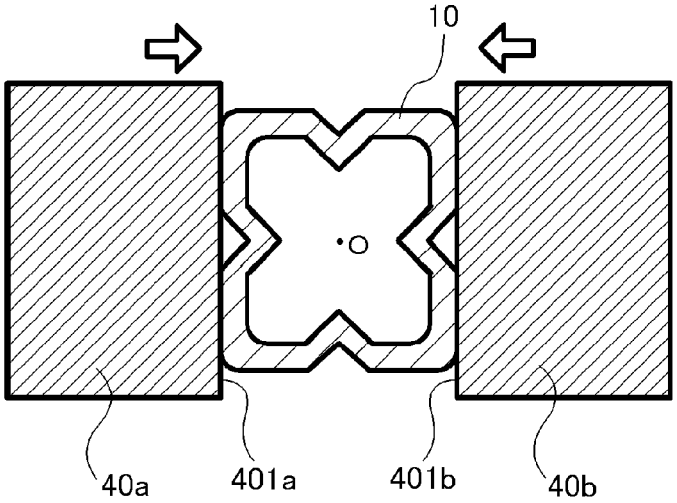
FIG. 4 depicts a cross-sectional view showing one tube-radially reducing step of pressing the end of the rectangular tube having the V-shaped grooves formed thereon.
Figure 5:
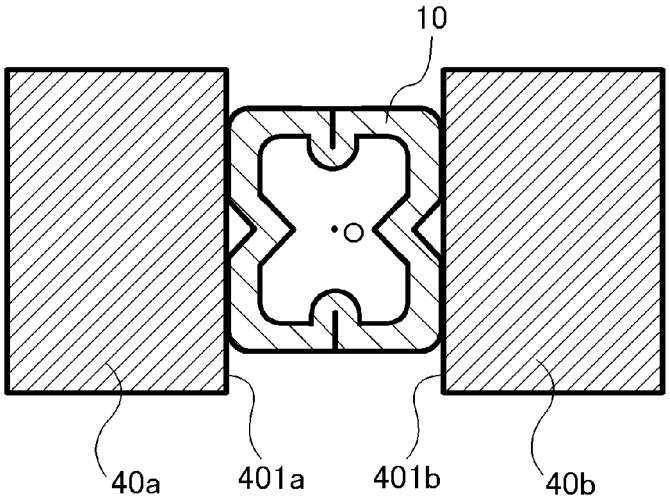
FIG. 5 depicts a cross-sectional view showing further tube-radially reducing step of pressing the end of the rectangular tube having the V-shaped grooves formed thereon.
Figure 6:
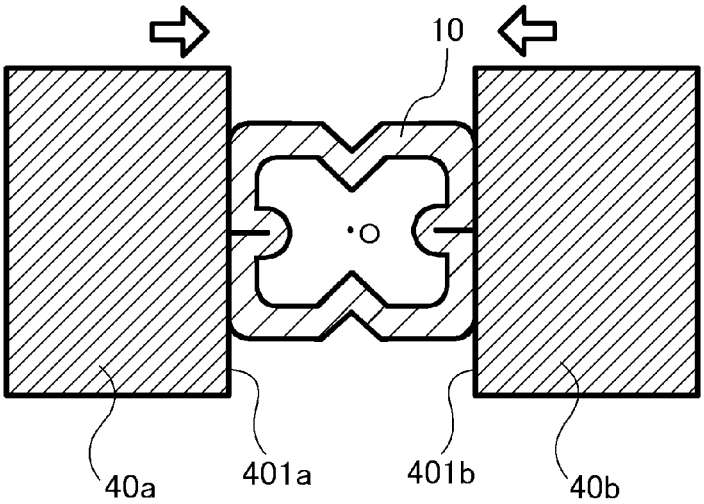
FIG. 6 depicts a cross-sectional view showing still further tube-radially reducing step of pressing the end of the rectangular tube having the V-shaped grooves formed thereon.
Figure 7:
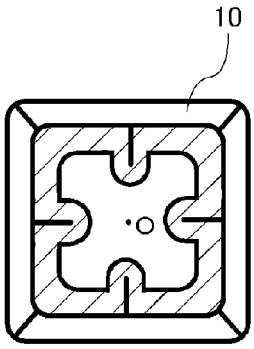
FIG. 7 depicts a cross-sectional view showing a radially reduced portion formed on the rectangular tube at the end thereof.
Figure 8:
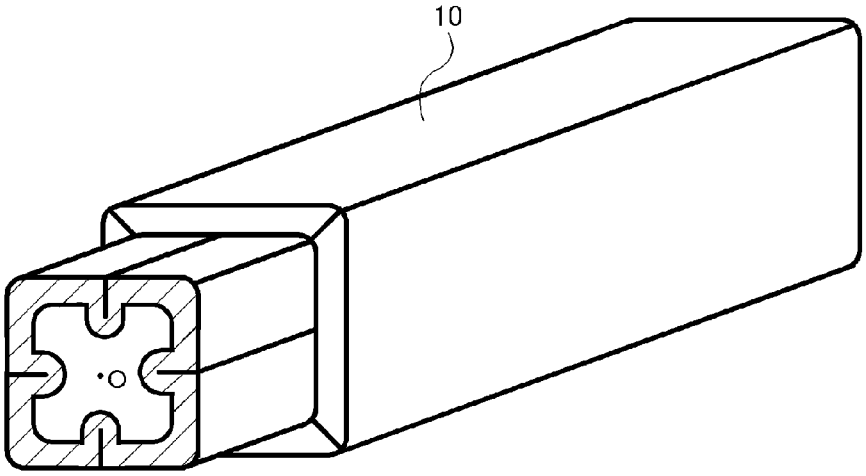
FIG. 8 depicts a perspective view showing the rectangular tube having the radially reduced portion formed at the end thereof.

After the V-shaped grooves are formed on their respective outer surfaces of the rectangular tube (10) at the end thereof through the use of the internal die (20) as well as one V-shaped external die (30*a*) and the other V-shaped external die (30*b*) as shown in FIGS. 1 to 3, the internal die (20) is pulled out from the rectangular tube (10). Subsequently, as shown in FIGS. 4 to 7, the end of the rectangular tube (10) is pressed from outside to inside by flat external dies (40*a*, 40*b*) while interposed therebetween so that the end of the rectangular tube (10) can be radially reduced by the application of pressure thereto. Surfaces (401*a*, 401*b*) of the flat external dies (40*a*, 40*b*) facing the rectangular tube (10) are planar and substantially parallel to the facing surfaces of the rectangular tube (10). By pressing the end of the rectangular tube (10) with the flat external dies (40*a*, 40*b*), the V-shaped grooves formed on the two surfaces, which do not face the surfaces (401*a*, 401*b*) of the flat external dies (40*a*, 40*b*), out of the surfaces of the end of the rectangular tube (10) are pressed so as to be deformed along the V-shaped grooves to the extent that the V-shaped grooves are closed (see FIG. 5). In such a fashion, only a portion having the V-shaped grooves formed thereon out of a whole portion of the rectangular tube (10) along a longitudinal direction can be radially reduced. After the step shown in FIG. 5, the rectangular tube (10) is rotated approximately 90 degrees around the center (O), which is regarded as substantially a center of rotation, and the two surfaces having the closed V-shaped grooves are arranged to face their respective surfaces (401*a*, 401*b*) of the flat external dies (40*a*, 40*b*). When the end of the rectangular tube (10) is pressed from outside to inside with the flat external dies (40*a*, 40*b*) (see FIG. 6), the V-shaped grooves are closed so that the radially reducing process can be completed. As a result, the rectangular tube (10) having the stepped portion for connection formed at the end thereof can be obtained as shown in FIGS. 7 and 8.

The surfaces (401*a*, 401*b*) of the flat external dies (40*a*, 40*b*) facing the rectangular tube (10) are not entirely limited to be in a planar shape. It is sufficient at least if portions of the surfaces contacting the rectangular tube (10) whose end is pressed are in a planar shape.

In such a fashion, by virtue of forming the V-shaped grooves in advance on the outer surfaces of the end of the rectangular tube (10), the V-shaped grooves formed on the two surfaces not facing the surfaces (401*a*, 401*b*) of the flat external dies (40*a*, 40*b*) are deformed so as to be closed therealong, when the two surfaces of the rectangular tube (10) facing the surfaces (401*a*, 401*b*) of the flat external dies (40*a*, 40*b*) are pressed. There can be suppressed, therefore, the bending of the radially reduced end of the rectangular tube (10), and the concavo-convex crimp likely to be generated on the radially reduced end. As a result, a rectangular tube having a stepped portion with favorable dimensional accuracy can be obtained.

Pressing means for pressing external dies used in radially reducing the end of a rectangular tube does not need to be limited in particular. It is sufficient if such pressing means is capable of processing a rectangular tube to predetermined dimensions. In other words, it is sufficient if the external dies can be pressed by a pressing machine or other equipment from both sides as the pressing means.

In the present invention, as will be described hereinafter, the two opposite surfaces of the rectangular tube (10) are processed simultaneously.

Figure 9:
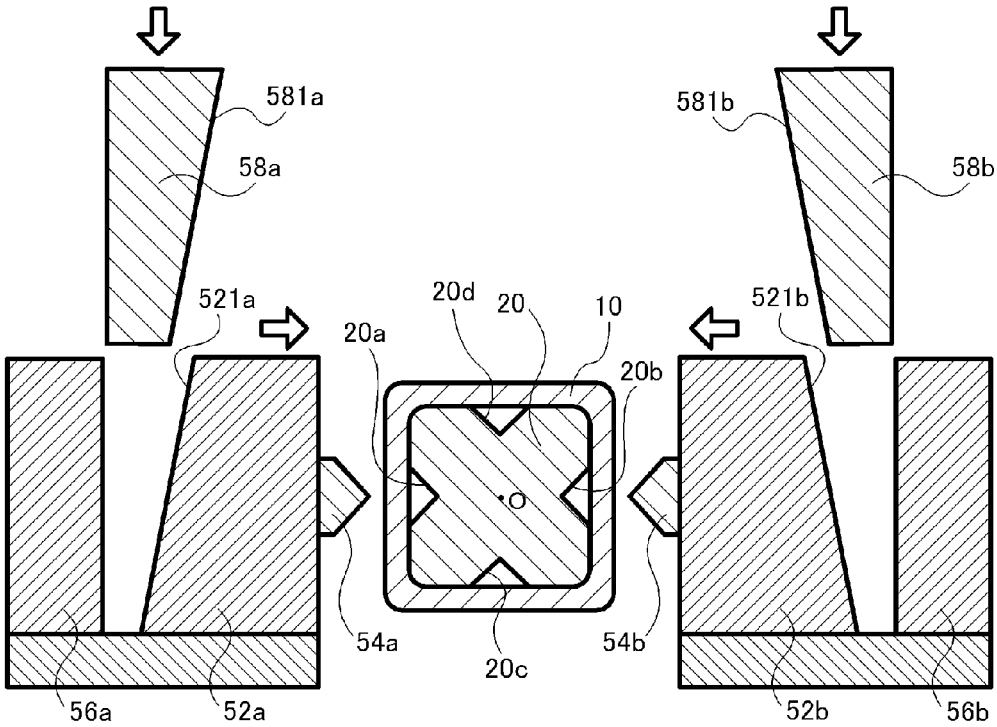
FIG. 9 depicts a cross-sectional view showing the end of the rectangular tube having an internal die inserted therein, V-shaped external dies, fixed bases, and wedge-shaped tools.

Inclined surfaces (521*a*, 521*b*) are formed on the V-shaped external dies (52*a*, 52*b*) at sides opposite to the surfaces contacting the rectangular tube (10) (see FIG. 9). Further, fixed bases (56*a*, 56*b*) are arranged to be fixed at positions opposite to the rectangular tube (10) with respect to the V-shaped external dies (52*a*, 52*b*), respectively, such that the fixed bases (56*a*, 56*b*) face their respective inclined surfaces (521*a*, 521*b*). Still further, the V-shaped external dies (52*a*, 52*b*) are configured to be moved toward the rectangular tube (10) by squeezing wedge-shaped tools (58*a*, 58*b*) having their respective inclined surfaces (581*a*, 581*b*) along the inclined surfaces (521*a*, 521*b*) of their respective V-shaped external dies (52*a*, 52*b*) between the V-shaped external dies (52*a*, 52*b*) and the fixed bases (56*a*, 56*b*), respectively (see FIGS. 9 and 10). By this means, through the movement in one direction from the upper side to the lower side in FIG. 9 i.e. squeezing the wedge-shaped tools (58*a*, 58*b*) between the V-shaped external dies (52*a*, 52*b*) and the fixed bases (56*a*, 56*b*), respectively, the two opposite surfaces of the rectangular tube (10) can be simultaneously pressed (V-shaped groove processing). Assuming that the V-shaped external dies (30*a*, 30*b*) are used for processing V-shaped grooves by simultaneously pressing the two surfaces at the end of a tube, the simultaneous movement of two dies in opposite directions would be required. On the other hand, according to the present invention, one action i.e. squeezing two wedge-shaped tools (58*a*, 58*b*) simultaneously from the upper side to the lower side in FIG. 9 through the use of e.g. a general-purpose pressing machine is sufficient.

Figure 12:
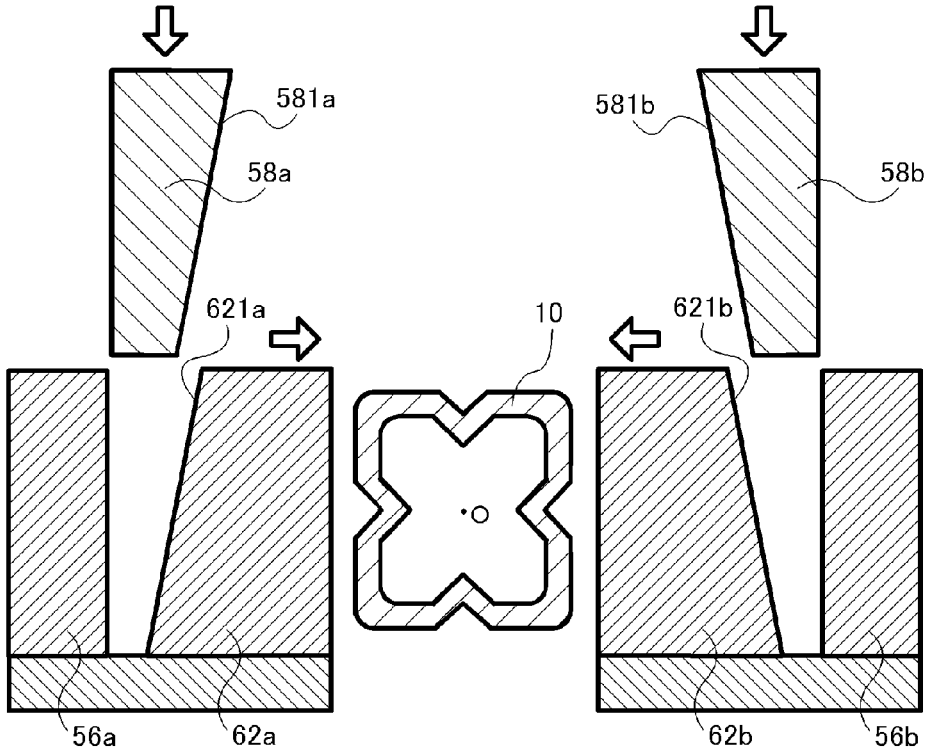
FIG. 12 depicts a cross-sectional view showing one step of pressing the end of the rectangular tube having the V-shaped grooves formed thereon so as to radially reduce the end.
Figure 13:
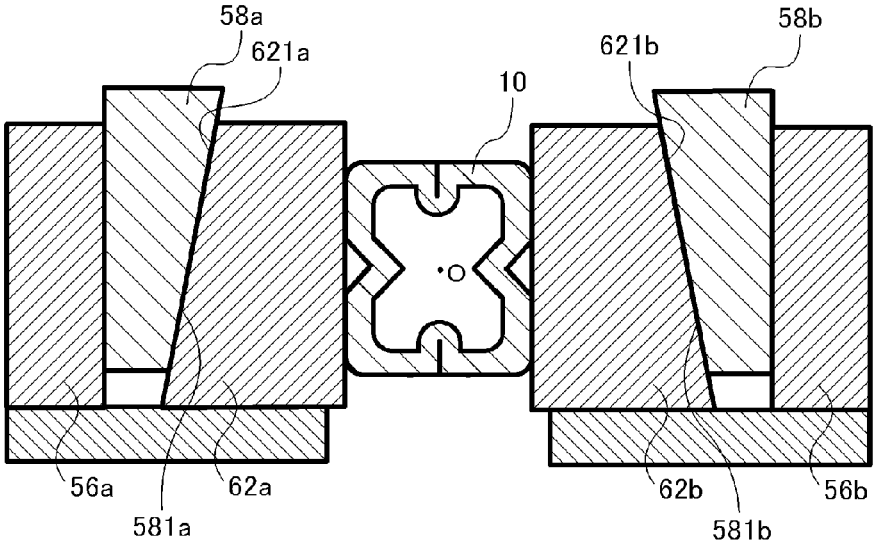
FIG. 13 depicts a cross-sectional view showing further step of pressing the end of the rectangular tube having the V-shaped grooves formed thereon so as to radially reduce the end.
Figure 14:
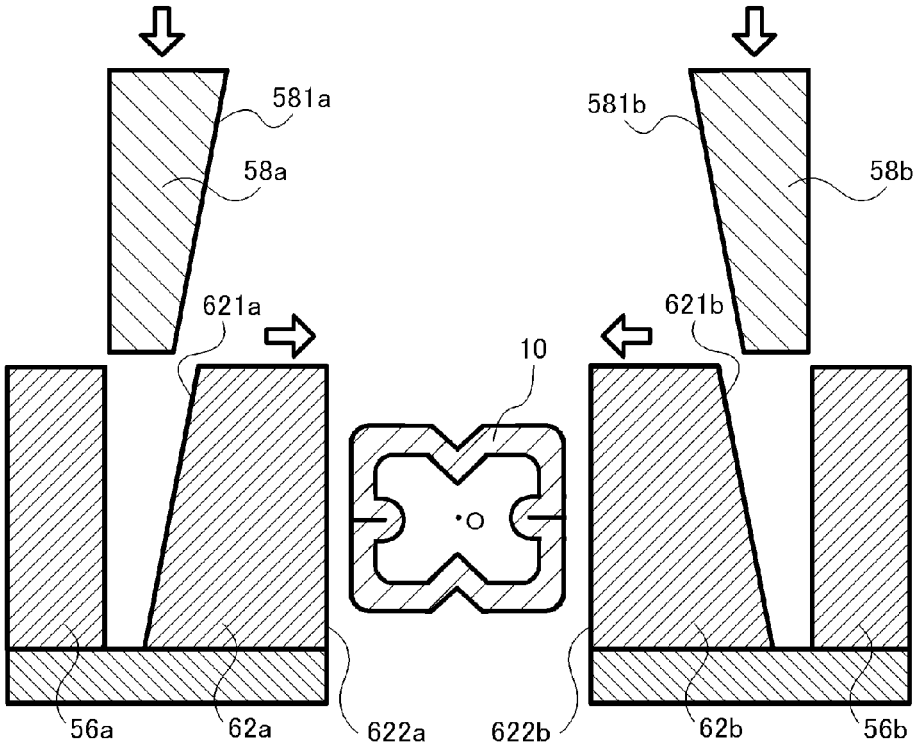
FIG. 14 depicts a cross-sectional view showing still further step of pressing the end of the rectangular tube having the V-shaped grooves formed thereon so as to radially reduce the end.

As shown in FIGS. 12 to 14, in a similar fashion, inclined surfaces (621*a*, 621*b*) may be formed on the flat external dies (62*a*, 62*b*), which are used for radially reducing the end of the rectangular tube (10) having the V-shaped grooves formed thereon, at sides opposite to the surfaces contacting the rectangular tube (10). Also in such a case, the two opposite surfaces of the rectangular tube (10) can be simultaneously processed (i.e. radially reduced) by the movement in only one direction from the upper side to the lower side in FIG. 12 i.e. squeezing the wedge-shaped tools (58*a*, 58*b*) between the flat external dies (62*a*, 62*b*) and the fixed bases (56*a*, 56*b*).

The V-shaped groove processing and the rectangular tube (10) radially reducing through the use of dies provided with the wedge-shaped tools (58*a*, 58*b*) will be specifically described with reference to FIGS. 9 to 16. Initially, the internal die (20) having the V-shaped concave portions (20*a*, 20*b*, 20*c*, 20*d*) formed thereon is inserted into the end of the rectangular tube (10) (see FIG. 9). Subsequently, the V-shaped external dies (52*a*, 52*b*) having the V-shaped convex portions (54*a*, 54*b*) formed on the surfaces thereof are arranged such that the V-shaped convex portions (54*a*, 54*b*) are opposite to the concave portions (20*a*, 20*b*) of the internal die (20) across the rectangular tube (10) (see FIG. 9).

Figure 10:
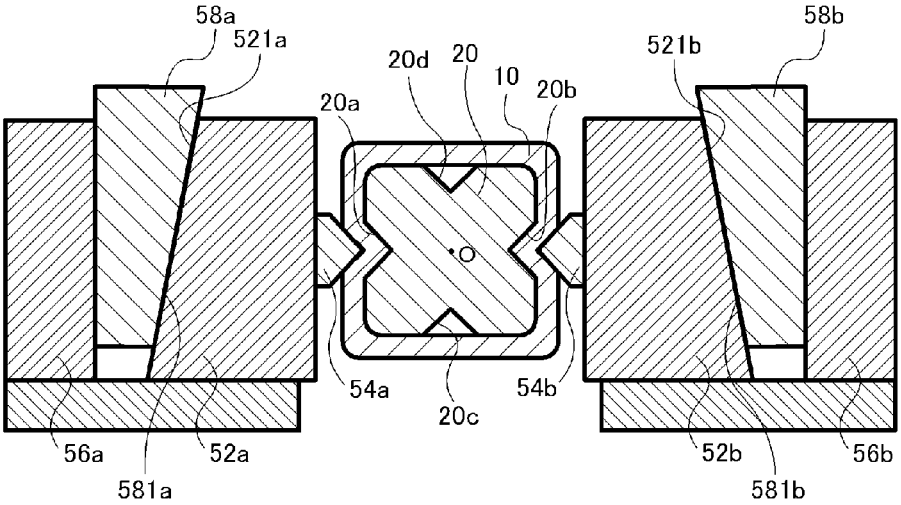
FIG. 10 depicts a cross-sectional view showing one step of forming V-shaped grooves on the rectangular tube at the end thereof.
Figure 11:
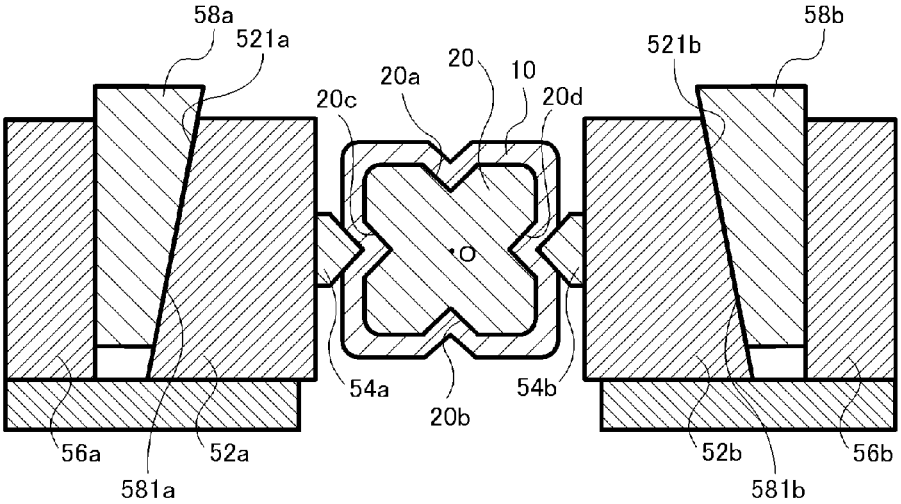
FIG. 11 depicts a cross-sectional view showing further step of forming further V-shaped grooves on the rectangular tube at the end thereof.

Subsequently, by pressing the wedge-shaped tool (58*a*) from the upper side to the lower side in FIG. 9 through the use of e.g. a general-purpose pressing machine, the wedge-shaped tool (58*a*) is inserted between the fixed base (56*a*) and the V-shaped external die (52*a*) so that the convex portion (54*a*) can be pressed against the rectangular tube (10) (see FIG. 10). When the wedge-shaped tool (58*a*) and the wedge-shaped tool (58*b*) are simultaneously pressed by the general-purpose pressing machine, the wedge-shaped tool (58*a*) is squeezed between the fixed base (56*a*) and the V-shaped external die (52*a*), and at the same time, the wedge-shaped tool (58*b*) is squeezed between the fixed base (56*b*) and the V-shaped external die (52*b*) so that the convex portion (54*b*) can be pressed against the rectangular tube (10) (see FIG. 10). It is possible to simultaneously form the V-shaped grooves on the two opposite surfaces of the rectangular tube (10) at the end thereof by simultaneously carrying out a pressing step through the use of the wedge-shaped tools (58*a*, 58*b*). After the step shown in FIG. 10, the rectangular tube (10) is rotated approximately 90 degrees around the center (O) as substantially a center of rotation. For the two surfaces having no V-shaped grooves formed thereon, the wedge-shaped tools (58*a*, 58*b*) are inserted between the V-shaped external dies (52*a*, 52*b*) and the fixed bases (56*a*, 56*b*), respectively, in a similar fashion (see FIG. 11). Through such one-direction movement from the upper side to the lower side in FIG. 9, the rectangular tube (10) can be formed with the V-shaped grooves on the surfaces of the end thereof.

Subsequently, the internal die (20) is pulled out from the rectangular tube (10). As shown in FIGS. 12 to 14, the flat external dies (62*a*, 62*b*) are arranged such that the end of the rectangular tube (10) having V-shaped grooves formed thereon is interposed therebetween. By pressing the wedge-shaped tools (58*a*, 58*b*) from the upper side to the lower side as shown in FIG. 12 through the use of a general-purpose pressing machine, the wedge-shaped tools (58*a*, 58*b*) are squeezed along the inclined surfaces (621*a*, 621*b*) of the flat external dies (62*a*, 62*b*), and the flat external dies (62*a*, 62*b*) are pressed against the rectangular tube (10) (see FIGS. 12 and 13). Accordingly, only a portion having the V-shaped grooves formed thereon out of a whole portion of the rectangular tube (10) along a longitudinal direction can be radially reduced.

Figure 15:
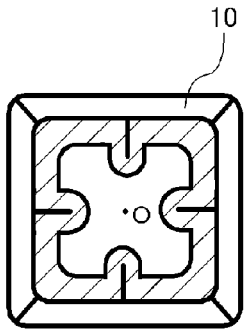
FIG. 15 depicts a cross-sectional view showing a radially reduced portion formed on the rectangular tube at the end thereof.
Figure 16:
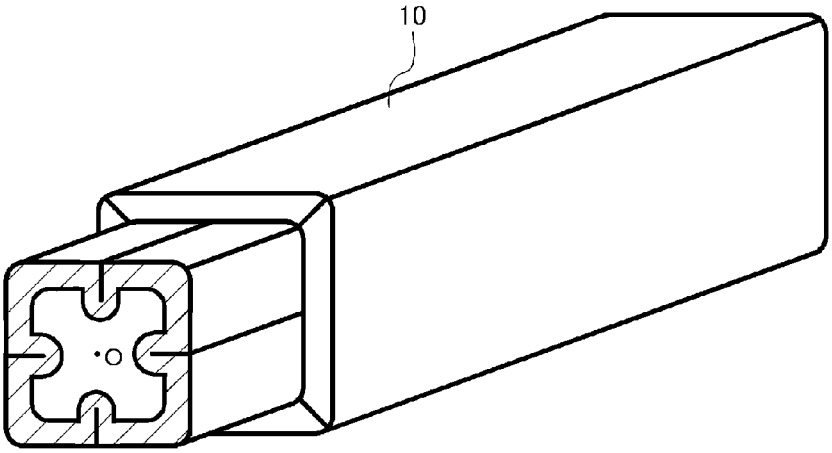
FIG. 16 depicts a perspective view showing the rectangular tube having the radially reduced portion formed at the end thereof.

After the step shown in FIGS. 12 and 13, the rectangular tube (10) is rotated approximately 90 degrees around the center (○) as substantially a center of rotation, and arranged such that the two surfaces having the not-yet-closed V-shaped grooves do not face the surfaces (622*a*, 622*b*) of the flat external dies (62*a*, 62*b*), respectively (see FIG. 14). In other words, the rectangular tube (10) is arranged such that the two surfaces having the closed V-shaped grooves face the two surfaces (622*a*, 622*b*) of the flat external dies (62*a*, 62*b*), respectively. Subsequently, the wedge-shaped tools (58*a*, 58*b*) are squeezed along the inclined surfaces (621*a*, 621*b*) of the flat external dies (62*a*, 62*b*), and the flat external dies (62*a*, 62*b*) are pressed against the rectangular tube (10) by pressing the wedge-shaped tools (58*a*, 58*b*) in an arrow direction from the upper side to the lower side in FIG. 14 through the use of e.g. a general-purpose pressing machine. In such a fashion, each surface having each V-shaped groove formed thereon can be radially reduced. By such a rational method using only a general-purpose pressing machine and equipment for rotating and moving a rectangular tube, the rectangular tube (10) having a stepped portion with favorable dimensional accuracy, as shown in FIGS. 15 and 16, can be obtained. In other words, merely through the use of a general-purpose pressing machine instead of any dedicated equipment, the bending of the radially reduced end when a rectangular tube is radially reduced can be suppressed, and the concavo-convex crimp likely to be generated on the radially reduced end can also be suppressed. As a result, the rectangular tube (10) having a stepped portion with favorable dimensional accuracy can be obtained while a capital-investment being suppressed.

EXAMPLES

Figure 17:
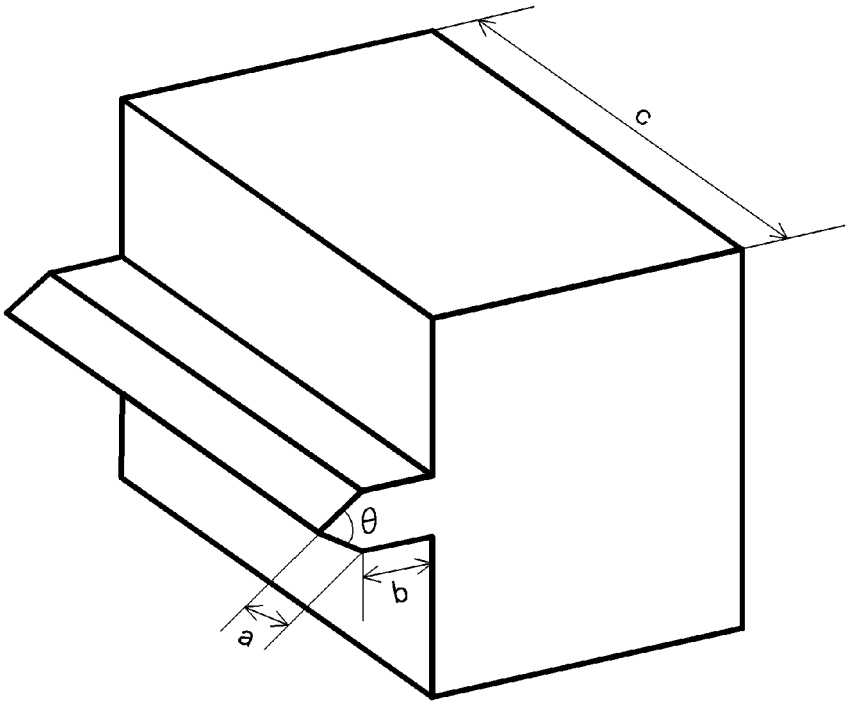
FIG. 17 depicts a view showing an example of a V-shaped external die used in the present example.
Figure 18:
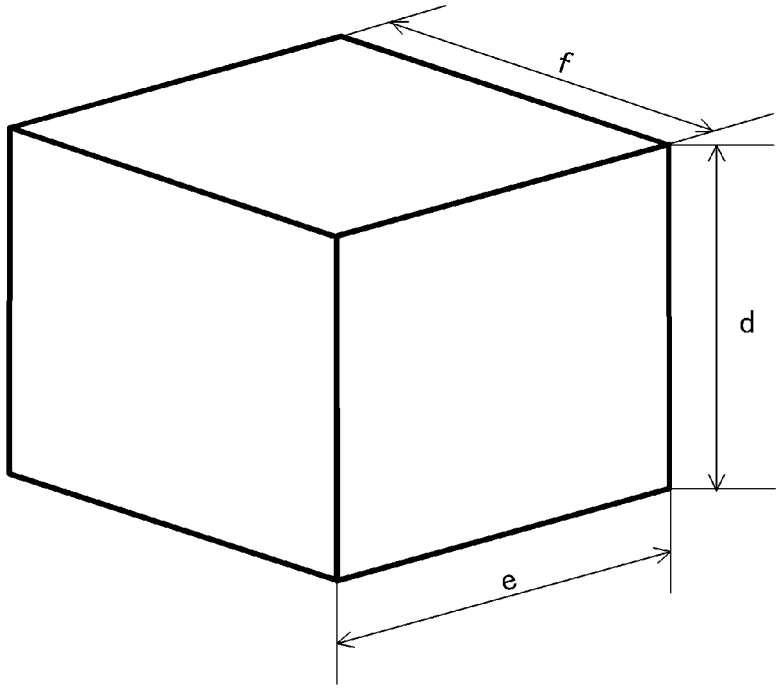
FIG. 18 depicts a view showing an example of a flat die used in the present example.
Figure 19:
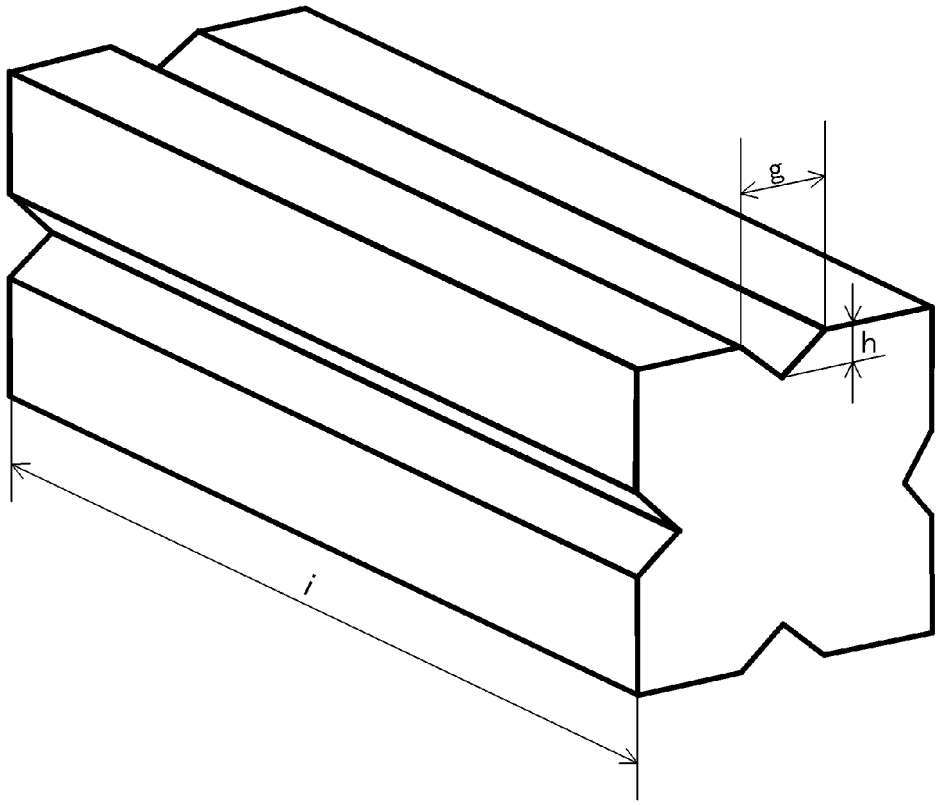
FIG. 19 depicts a view showing an example of an internal die used in the present example.

In the radially reducing process according to the present invention, the rectangular tube, which is 45 mm in length and is rectangular in cross-section, was used. Material for the rectangular tube is a high-strength steel plate that is 3.2 mm in thickness and 400 MPa in tensile strength. As shown in FIG. 17, for the V-shaped external die, the angle (θ) of a V-shaped tip of the convex portion is 45 degrees, the length of an inclined part (a) of the V-shaped tip of the convex portion is 20 mm, and the length of a flat part (b) of the convex portion protruding from the main body was 40 mm, the length (c) of a main body is 100 mm. As shown in FIG. 18, a flat die in substantially a cubic shape, which is 100 mm in height (d), 100 mm in width (e), and 100 mm in length (f), was used. As shown in FIG. 19, the internal die having formed thereon the V-shaped grooves of 10 mm in width (g), 5 mm in depth (h), and 120 mm in length (i) was used.

Initially, the internal die was inserted into one end of the rectangular tube. The V-shaped groove of 5 mm in depth, 10 mm in width, and 100 mm in total length in a longitudinal direction of the rectangular tube was formed on each surface of the rectangular tube by pressing the V-shaped external dies through the use of a hydraulic cylinder. The V-shaped grooves were formed simultaneously on the two laterally opposite surfaces of the rectangular tube, respectively. Subsequently, the rectangular tube was rotated 90 degrees, and the V-shaped grooves were formed on the other two surfaces of the rectangular tube.

Subsequently, the flat external dies were attached after the V-shaped external dies had been detached, and the flat external dies were pressed with a hydraulic cylinder. In a similar fashion to the above, the two surfaces of the rectangular tube having the V-shaped grooves formed thereon were simultaneously radially reduced to the extent that one side of the tube reaches 38 mm in width over 100 mm in length of the tube. As a comparison example, a tube end was radially reduced from 100 mm to 38 mm in width by pressing only with the flat external dies for the same rectangular tube and flat external dies as the above example without forming the V-shaped grooves.

As a result of comparison between the radially reducing method according to the present invention and the radially reducing method in the comparison example, the radially reduced end having specified dimensions could be readily formed when the radially reducing method according to the present invention was adopted, while some parts could not be radially reduced to the specified dimensions due to the generation of a concavo-convex crimp on each surface of the radially reduced end when the radially reducing method in the comparison example was adopted.

REFERENCE NUMERALS

10 rectangular tube
20 internal die
30*a*, 30*b*, 52*a*, 52*b* V-shaped external die
35*a*, 35*b* convex portion
40*a*, 40*b*, 62*a*, 62*b* flat external die
54*a*, 54*b* convex portion
56*a*, 56*b* fixed base
58*a*, 58*b* wedge-shaped tool

What is claimed is:

1. A method of manufacturing a rectangular tube having a stepped portion comprising a series of sequential steps comprising:

a first step of forming V-shaped grooves on the rectangular tube on a first pair of opposing surfaces and a second pair of opposing surfaces of an end thereof in a direction parallel to a longitudinal direction thereof; and a second step, after the first step, of successively pressing each of the surfaces having the V-shaped grooves formed thereon from outside to inside such that through contact of dies each having a flat planar surface corresponding to each of the first and second pair of opposing surfaces, the first pair of opposing surfaces are compressed, while the second pair of opposing surfaces are not being compressed, to thereby close the V-shaped grooves on the second pair of opposing surfaces, and thereafter the second pair of opposing surfaces are compressed, while the first pair of opposing surfaces are not being compressed, to thereby close the V-shaped grooves on the first pair of opposing surfaces, in a sequential manner, whereby the end of the rectangular tube is radially reduced as the stepped portion of a rectangular cross-sectional shape.

2. The method of manufacturing the rectangular tube having the stepped portion according to claim 1, wherein the first step of forming the V-shaped grooves on the rectangular tube at the surfaces of the end thereof comprises:

placing a first die having a V-shaped concave portion formed thereon inside the end of the rectangular tube;

placing a second die having a V-shaped convex portion formed thereon at a position that is opposite to the concave portion and is outside the end of the rectangular tube; and pressing the second die against the rectangular tube at each of the surfaces of the end thereof.

3. The method of manufacturing the rectangular tube having the stepped portion according to claim 2, wherein the second die has an inclined surface on a side opposite to a surface thereof contacting the rectangular tube, and a fixed base is arranged to be fixed at a position opposite to the rectangular tube across the second die, whereby the V-shaped grooves are formed by squeezing a wedge-shaped tool between the fixed base and the inclined surface of the second die so as to move the second die toward the rectangular tube.

4. The method of manufacturing the rectangular tube having the stepped portion according to claim 2, wherein a third die having an inclined surface on a side opposite to a surface thereof contacting the rectangular tube is placed, and a fixed base is arranged to be fixed at a position opposite to the rectangular tube across the third die, whereby the end of the rectangular tube is radially reduced by squeezing a wedge-shaped tool between the fixed base and the inclined surface of the third die so as to move the third die toward the rectangular tube and press the end of the rectangular tube.

5. The method of manufacturing the rectangular tube having the stepped portion according to claim 3, wherein a third die having an inclined surface on a side opposite to a surface thereof contacting the rectangular tube is placed, and the fixed base is arranged to be fixed at a position opposite to the rectangular tube across the third die, whereby the end of the rectangular tube is radially reduced by squeezing the wedge-shaped tool between the fixed base and the inclined surface of the third die so as to move the third die toward the rectangular tube and press the end of the rectangular tube.

* * * * *